US005244765A

United States Patent [19]

Katoh et al.

[11] Patent Number: 5,244,765

[45] Date of Patent: Sep. 14, 1993

[54] TONER FOR DEVELOPING LATENT ELECTROSTATIC IMAGES

[75] Inventors: Koichi Katoh; Masami Tomita, both of Numazu; Tomoe Hagiwara, Shizuoka, all of Japan

[73] Assignee: Ricoh Company, Ltd., Tokyo, Japan

[21] Appl. No.: 912,567

[22] Filed: Jul. 13, 1992

Related U.S. Application Data

[63] Continuation of Ser. No. 668,487, Mar. 13, 1991, abandoned.

[30] Foreign Application Priority Data

Mar. 15, 1990 [JP] Japan ..... 2-62600

[51] Int. Cl.[5] ..... G03G 9/00; G03G 5/00

[52] U.S. Cl. ..... 430/110; 430/111; 430/137

[58] Field of Search ..... 430/110, 111, 137, 904

[56] References Cited

U.S. PATENT DOCUMENTS 4,795,689 1/1989 Matsubara et al. ..... 430/110

4,994,340 2/1991 Yamazaki et al. ..... 430/106.6

*Primary Examiner*—Marion E. McCamish

*Assistant Examiner*—S. Rosasco

*Attorney, Agent, or Firm*—Cooper & Dunham

[57] ABSTRACT

A toner for developing latent electrostatic images which comprises a binder resin comprising a styrene polymer or a copolymer thereof, a releasing agent, dispersed in the above binder resin, comprising a low-molecular-weight polypropylene with a weight-average molecular weight of 3000 to 25000, and a coloring agent, dispersed in the above binder resin, with the styrene polymer or copolymer thereof being contained in a ratio of 10–50% and the low-molecular-weight polypropylene in a ratio of 5–60% at a surface portion of the above toner measured by the electron spectroscopy for chemical analysis (ESCA), and a maximum particle diameter of the low-molecular-weight polypropylene contained in the releasing agent being 5000 Å or less.

8 Claims, 1 Drawing Sheet

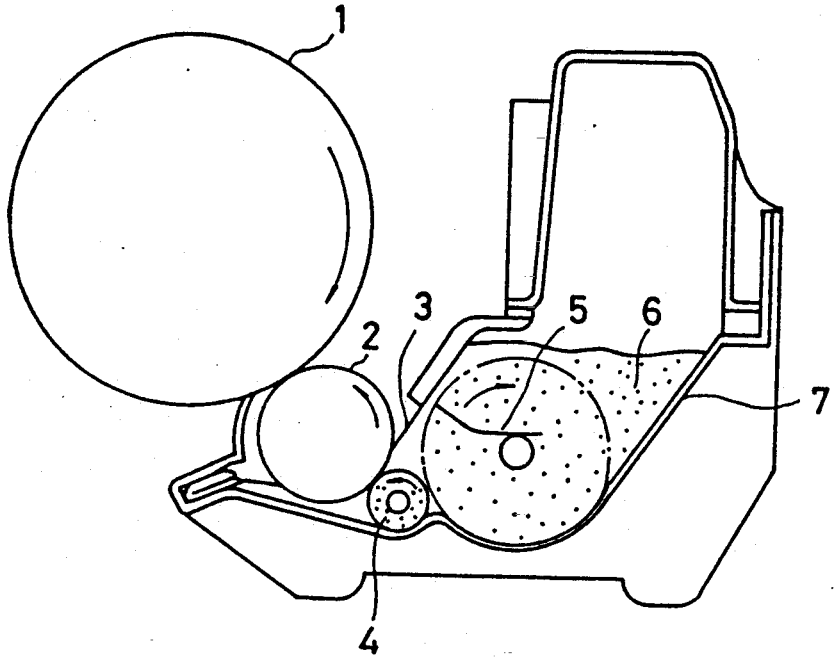
1
2
3
4
5
6
7

TONER FOR DEVELOPING LATENT ELECTROSTATIC IMAGES

This is a continuation of application Ser. No. 668,487, filed Mar. 13, 1991, now abandoned.

BACKGROUND OF THE INVENTION

1. Field of the Invention

The present invention relates to a toner comprising a binder resin, a coloring agent and a releasing agent for developing latent electrostatic images, which is used in the field of electrophotography, electrostatic recording and electrostatic printing.

2. Discussion of Background

Generally, latent electrostatic images are formed on a photoconductor in the electrophotographic process, and they are formed on a dielectric material in the electrostatic recording process. When the latent electrostatic images thus formed on the latent-electrostatic-image-supporting-member are developed into visible images with a dry-type toner, the above-mentioned toner, which is in the form of finely-divided particles, is supplied to the surface of a toner-supply roller such as a development sleeve and uniformly distributed around the toner-supply roller by a toner-layer-thickness regulation blade to form a thin toner layer. While the toner is frictioned, it is positively or negatively charged. The toner is thus attracted by the latent electrostatic images formed on the latent-electrostatic-image-supporting member. The visible toner images thus formed are transferred onto a transfer material such as a sheet of paper when necessary, and fixed thereon by the application of heat and pressure thereto or by the application of a vaporized solvent.

For developing the latent electrostatic images formed on the latent-electrostatic-image-supporting member into visible images, there are conventionally proposed two methods; a wet-type developing method using a liquid type developer and a dry-type developing method using a dry-type developer, as previously noted. The dry-type developer includes a one-component dry-type developer comprising a toner and a two-component dry-type developer comprising a toner and a carrier.

When the two-component dry-type developer is employed, the development method varies depending upon the kind of carrier contained in the developer. For instance, when iron powder is used as the carrier, latent electrostatic images are developed by the magnetic brush development process. In the case where beads carrier is employed, cascade development process is performed. Furthermore, when the above-mentioned beads carrier is replaced by a fur brush, latent electrostatic images are developed by the fur brush development process.

On the other hand, in the case of the one-component dry-type developer, there are also many methods for developing latent electrostatic images For example;

(i) Powder cloud development: Development is performed by toner particles which are sprayed through a nozzle in the air.

(ii) Contact development (or toner development): Development is performed by physically bringing toner particles into contact with the latent electrostatic images.

(iii) Jumping development: Development is performed by charging toner particles to a predetermined polarity and causing them to jump at the latent electrostatic images having an electrical field.

(iv) Magne-dry development: Development is performed by bringing magnetic electroconductive toner particles into contact with the latent electrostatic images.

The conventional toners which are applicable to the aforementioned development methods comprise a low-molecular-weight polyethylene or polypropylene as a releasing agent to prevent the off-set phenomenon in the image fixing operation. Compatibility of this kind of releasing agent with a styrene-based binder resin is not so good that a releasing agent component and a binder resin component are separated while kneaded to prepare a toner composition. The interfaces between two components are easily broken and toner particles are thus finely ground when the mechanical force is applied thereto. Such a phenomenon occurs at the contact surface of the photoconductor and the transfer sheet, the contact surface of the development sleeve and the toner-layer-thickness regulation blade, and the contact surface of the development sleeve and the photoconductor.

In the case where the latent electrostatic images are developed by the aforementioned contact development process, the finely ground toner particles are deposited on the surface of the development sleeve and assume in the fused state with time. As a result, a so-called toner-filming phenomenon takes place. Because of this phenomenon, the thickness of a thin toner layer around the development sleeve becomes nonuniform and the charge quantity of the toner becomes uneven. This makes it impossible to constantly yield images with a high image density. This is a critical problem to the image quality.

To avoid the toner-filming phenomenon, therefore, a high-molecular-weight polymer is blended in the toner. However, in the case where the latent electrostatic images are developed into visible toner images with the toner comprising the high-molecular-weight polymer, it is required to raise an image fixing temperature while the toner images are fixed onto a transfer sheet with the application of heat thereto. Consequently, much thermal energy is required at the image fixing step, which has an adverse effect on the energy saving In addition, the size of a copying apparatus cannot be decreased.

Another proposal is made to avoid the toner-filming phenomenon. Namely, there is proposed a toner comprising a small amount of a plasticizer. This kind of toner does not necessarily succeed in preventing the toner-filming phenomenon. This is because the fluidity of the toner is decreased and the toner particles adhere to the carrier and the carrier is stained therewith (so-called spent-toner problem).

When the toner is too hard, on the contrary, it is difficult to mechanically crush the toner and various components in the toner composition cannot sufficiently be dispersed.

Under such circumstances, the conventional toner comprises as a binder resin a relatively low-molecular weight polystyrene or a styrene - butyl methacrylate copolymer which has an appropriate hardness. However, it is confirmed that the hardness of the above-mentioned relatively low-molecular weight polystyrene and styrene-butyl methacrylate copolymer is not sufficient when they are used in, for example, a laser printer, which is expected to be maintenance-free. In addition, this kind of binder resin is disadvantageous when the image is fixed onto a transfer sheet by using a heat-application roller. Specifically, although the adhesion of this kind of binder resin to a transfer sheet is good, it also sticks to a heat-application roller and causes the off-set phenomenon.

In order to prevent the above-mentioned toner-filming phenomenon on the development sleeve and the photoconductor, and solve the spent-toner problem, various proposals are further made. For example;

(1) A metallic soap is used as a fluidity-promoting agent in Japanese Laid-Open Patent Applications 47-36405 and 47-36830.

(2) A fluorine-containing compound is used as a fluidity-promoting agent in Japanese Laid-Open Patent Applications 52-153441 and 53-147541.

(3) A nonionic surface active agent is used as a fluidity-promoting agent in Japanese Laid-Open Patent Application 54-8534.

(4) Silica, the surface of which is treated to be hydrophobic is used as a fluidity-promoting agent in Japanese Laid-Open Patent Application 56-62256.

(5) Particles whose hardness is higher than that of a toner particle are embedded into the toner as in Japanese Laid-Open Patent Application 56-66856.

(6) An ion exchange resin is contained in the binder resin as in Japanese Laid-Open Patent Application 58-134651.

(7) A toner comprises an oxidized polyethylene as a releasing agent, which is compatible with the binder resin, as in Japanese Laid-Open Patent Application 59-131943.

(8) A silicone oil is contained in a binder resin as in Japanese Laid-Open Patent Application 56-197048

(9) Finely-divided particles of wax are attached to the surfaces of toner particles as in Japanese Laid-Open Patent Application 59-220748.

(10) Particles of carbon black are attached to the surfaces of toner particles to lower the resistivity of the toner as in Japanese Laid-Open Patent Application 60-138565

(11) Finely-divided particles of various polymers are attached to the surfaces of toner particles as in Japanese Laid-Open Patent Applications 60-186851, 60-186852, 60-186853, 60-186854, 60-186855, 60-186857, 60-186858, 60-186860, 60-186861, 60-186862, 60-186863, 60-186864, 60-186865 and 60-186866.

(12) Particles of an abrasive agent (SiC or SiN) are attached to the surfaces of toner particles as in Japanese Laid-Open Patent Application 61-99164.

The aforementioned additives do not successfully prevent the toner-filming phenomenon and solve the spent-toner problem.

SUMMARY OF THE INVENTION

Accordingly, a first object of the present invention is to provide a toner for developing latent electrostatic images, which is not easily disintegrated into minute particles on a photoconductor and a development sleeve when a mechanical force is applied thereto, and which does not give rise to the toner-spent problem and the toner-filming phenomenon on the development sleeve and the photoconductor due to the frictional heat generated between the development sleeve and the photoconductor, and between the development sleeve and the toner-layer-thickness regulation blade.

The above-mentioned object of the present invention can be achieved by a toner for developing latent electrostatic images which comprises a binder resin comprising a styrene polymer or a copolymer thereof, a releasing agent, dispersed in the above binder resin, comprising a low-molecular-weight polypropylene with a weight-average molecular weight of 3,000 to 25,000, and a coloring agent, dispersed in the above binder resin, with the content of the styrene polymer or oopolymer thereof being in a ratio of 10–50% and the content of the low-molecular weight polypropylene in a ratio of 5–60% at a surface portion of the above toner measured by the electron spectroscopy for chemical analysis (ESCA), and a maximum particle diameter of the low-molecular-weight polypropylene contained in the releasing agent being 5000 Å or less.

BRIEF DESCRIPTION OF THE DRAWING

In the drawing, the single FIGURE is a schematic cross-sectional view of a development unit for use in the present invention.

DESCRIPTION OF THE PREFERRED EMBODIMENTS

In the present invention the electron spectroscopy for chemical analysis (ESCA) is employed to analyze the surface composition of the toner particle of the toner of the present invention. The ESCA is an appropriate spectroscopic method for quantitatively analyzing the chemical structure of a surface portion of organic compounds, and has been widely used in recent years.

When an X-ray is applied to an unknown sample compound according to the ESCA, the sample compound releases photoelectrons having various kinetic energies by a photoelectric effect. The unknown sample compound can be identified from the aforementioned kinetic energies of the photoelectrons released therefrom Most polymers show spectra having a relatively broad peak. The waveform of a spectrum of a polymer is analyzed by a computer to find the kind and the amount of functional groups contained in the polymer For example, the surface composition of a toner can be determined in detail by the measurement of the $C_{18}$ spectrum thereof in accordance with the ESCA. Thus, the amount ratio of the polypropylene component and the polystyrene component oriented in the surface portion of the toner can be measured.

To analyze the chemical structure of the toner in accordance with the ESCA, the toner is fixed on a glass plate by using a double-sided adhesive tape and the measurement is performed without subjecting the surface of the toner to sputtering.

In addition, the dispersed condition of the polypropylene component in the binder resin of the toner can be observed by the conventional transmission type electron microscope (TEM). Specifically, a sample toner layer is prepared in a thickness of about 1000 Å and dyed in a solution of osmium tetroxide at 60° C. for 3 hours. The toner sample layer is observed by the TEM to measure the maximum diameter of the polypropylene particle in the direction of the major axis thereof dispersed in the binder resin.

According to the present invention, when the low-molecular-weight polypropylene is contained in a ratio of 5–60% in the surface portion of the toner, not only the off-set phenomenon can be avoided, which takes place when the transferred image is fixed on a transfer sheet by a heat-application roller at the image fixing step, but also the toner-filming phenomenon on the surfaces of the development sleeve and the photoconductor can be prevented.

Examples of monomers for producing the binder resin for use in the present invention are styrene and styrene derivatives, such as o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, 3,4-dichlorostyrene; ethylene and ethylene-based unsaturated monoolefins such as propylene, butylene and isobutylene; halogenated vinyls such as vinyl chloride, vinylidene chloride, vinyl bromide and vinyl fluoride; vinyl esters such as vinyl acetate and vinyl propionate; α-methylene aliphatic monocarboxylic acid esters such as methyl acrylate, ethyl acrylate, n-butyl acrylate, methyl methacrylate and ethyl methacrylate; vinyl ethers such as vinyl methyl ether; vinylketones such as vinyl methyl ketone; N-vinyl compounds such as N-vinylpyrrole, N-vinylcarbazole, N-vinylindole and N-vinylpyrrolidone. These monomers can be used alone or in combination.

Examples of monomers for producing a condensation resin serving as the binder resin of the toner in the present invention include polyhydroxy alcohols, such as ethylene glycol, triethylene glycol, 1,2-propylene glycol, bisphenol A, hydrogenated bisphenol A, polyoxyethylene-containing bisphenol A and polyoxypropylene-containing bisphenol A; amines such as ethylene diamine and tetramethylenediamine piperazine; and maleic acid, fumaric acid, mesaconic acid, citraconic acid, adipic acid and malonic acid, and acid anhydrides thereof and esters thereof with lower alcohols The toner according to the present invention comprises a coloring agent and a charge controlling agent. Examples of the coloring agent for use in the present invention include carbon black, Oil Black, nigrosine dyes, metal chelate dyes such as a metal-containing dye, aniline dyes, Calconyl Blue, Chrome Yellow, Ultramarine Blue, Methylene Blue Chloride, Phthalocyanine Blue, Rose Bengale and other dyes and pigments.

The toner according to the present invention further comprises the releasing agent comprising the low-molecular-weight polypropylene with a weight-average molecular weight of 3,000 to 25,000. When the above polypropylene is dispersed in the binder resin comprising the styrene polymer or styrene copolymer, a maximum particle diameter of the low-molecular-weight polypropylene is 5000 Å or less in the present invention. Since the polypropylene particle is relatively small in the dispersed condition, as previously mentioned, the polypropylene can uniformly be dispersed in the styrene-based binder resin in spite of poor compatibility between the polypropylene and the styrene.

To prepare the toner according to the present invention, for example, an extruder is used to knead the mixture of a styrene-based binder resin, a releasing agent comprising a low-molecular-weight polypropylene and a coloring agent. In particular, when a double-screw extruder is employed, the mixture can sufficiently be kneaded and the size of a polypropylene particle of the releasing agent can remarkably be reduced under application of a high shear force.

For example, a mixture of polyphenylene ether, polystyrene, acrylic resin and low-molecular-weight polypropylene is kneaded and grounded in the extruder with the addition thereto of carbon black and a charge controlling agent. The mixture thus obtained is classified, so that a toner according to the present invention can be prepared.

When image formation is performed using the above-prepared toner, the toner particles are not smashed into minute particles and not attached to the photoconductor or development sleeve. The toner-filming phenomenon does not occur. Consequently, the thin toner layer can uniformly be formed around the development sleeve, and the latent electrostatic images formed on the photoconductor can satisfactorily be developed into visible toner images.

Other features of this invention will become apparent in the course of the following description of exemplary embodiments, which are given for illustration of the invention and are not intended to be limiting thereof.

EXAMPLE 1

The following components were mixed and kneaded in an extruder. The thus obtained mixture was pulverized and classified, so that a toner with an average particle diameter of 10 μm according to the present invention was obtained.

| | Parts by Weight |
|---|---|
| Styrene/butyl methacrylate (8:2) | 65 |
| Polyester | 30 |
| Polypropylene | 5 |
| Di-tert-butyl-zinc salicylate | 4 |
| Carbon black | 5 |

The surface composition of the above-prepared toner was measured by the ESCA. As a result, the polypropylene component was in a ratio of 26% and the styrene component, in a ratio of 35%. The maximum particle diameter of a polypropylene component was 1800 Å.

The one-component non-magnetic toner obtained in Example 1 was used in a development unit as shown in the single figure. In the development unit as shown in the single figure, a toner 6 placed in a toner reservoir 7 is forcibly brought onto a sponge roller 4 by a stirring blade 5, so that the toner 6 is supplied onto the sponge roller 4. As the sponge roller 4 is rotated in the direction of the arrow, the toner 6 fed to the sponge roller 4 is transported onto a toner transportation member 2, where the toner 6 is frictioned, and electrostatically or physically attracted to the toner transportation member 2. As the toner transportation member 2 is rotated in the direction of the arrow, a uniformly thin layer of the toner 6 is formed on the toner transportation member 2 by an elastic blade 3. At the same time, the thin toner 6 is then transported onto the surface of a latent electrostatic image bearing member 1 which is situated in contact with or adjacent to the toner transportation member 2, so that the latent electrostatic image is developed to a visible toner image.

The toner obtained in Example 1 was subjected to an image formation test using the development unit as shown in the single figure. The initial images obtained by the above test were clear. Even after 100,000 copies were made, the obtained images were still excellent in quality.

The initial charge quantity of the toner was −12.8 μC/g. After the making of 100,000 copies, the charge quantity of the toner was −11.7 μC/g, which was almost the same as the initial charge quantity of the toner.

In addition, the film forming of the toner on the photoconductor or development sleeve was not observed

EXAMPLE 2

The following components were mixed and kneaded in an extruder. The thus obtained mixture was pulverized and classified, so that a toner with an average particle diameter of 11 μm according to the present invention was obtained.

| | Parts by Weight |
|---|---|
| Styrene | 65 |
| Methacrylic acid | 10 |
| n-butyl methacrylate | 20 |
| Polypropylene | 5 |
| Di-tert-butyl-zinc salicylate | 4 |
| Carbon black | 6 |

The surface composition of the above-prepared toner was measured by the ESCA. As a result, the polypropylene component was in a ratio of 22% and the styrene component, in a ratio of 31%. The maximum diameter of a polypropylene particle was 1600 Å.

The toner obtained in Example 2 was subjected to the same image formation test as in Example 1, using the development unit as shown in the single figure. The initial images obtained by the above test were clear. Even after 80,000 copies were made, the obtained images were still excellent in quality.

The initial charge quantity of the toner was −9.2 μC/g. After the making of 80,000 copies, the charge quantity of the toner was −9.3 μC/g, which was almost the same as the initial charge quantity of the toner.

In addition, the film forming of the toner on the photoconductor or development sleeve was not observed.

EXAMPLE 3

The following components were mixed and kneaded in an extruder. The thus obtained mixture was pulverized and classified, so that a toner with an average particle diameter of 10 μm according to the present invention was obtained.

| | Parts by Weight |
|---|---|
| Styrene | 40 |
| Methacrylic acid | 5 |
| n-butyl methacrylate | 45 |
| 2-ethylhexyl acrylate | 5 |
| Polypropylene | 5 |
| Di-tert-butyl-zinc salicylate | 6 |
| Carbon black | 10 |

The surface composition of the above-prepared toner was measured by the ESCA. As a result, a polypropylene component was in a ratio of 20% and a styrene component, in a ratio of 38%. The maximum diameter of a polypropylene particle was 1750 Å.

The toner obtained in Example 3 was subjected to the same image formation test as in Example 1, using the development unit as shown in the single figure. The initial images obtained by the above test were clear. Even after 200,000 copies were made, the obtained images were still excellent in quality.

The initial charge quantity of the toner was −13.7 μC/g. After the making of 200,000 copies, the charge quantity of the toner was −13.5 μC/g, which was almost the same as the initial charge quantity of the toner.

In addition, the film forming of the toner on the photoconductor or development sleeve was not observed.

COMPARATIVE EXAMPLE 1

The procedure for preparation of the toner employed in Example 1 was repeated except that the extruder used in Example 1 was replaced by a two-roll mill for kneading a toner composition, so that a comparative toner was obtained.

The surface composition of the above-prepared comparative toner was measured by the ESCA. As a result, the polypropylene component was in a ratio of 70% and the styrene component was in a ratio of 7%. The maximum diameter of a polypropylene particle was as large as 5600 Å.

The toner obtained in Comparative Example 1 was subjected to an image formation test using the development unit as shown in the single figure. The initial images obtained by the above test were not clear. After 10,000 copies were made, the quality of the obtained images was further degraded.

The initial charge quantity of the toner was −8.7 μC/g. After the making of 10,000 copies, the charge quantity of the toner was lowered to −2.3 μC/g.

In addition, the toner in fused state was attached to the photoconductor or development sleeve.

As previously mentioned, the toner according to the present invention does not cause the toner-filming phenomenon on the photoconductor and the toner-layer-thickness regulation blade. Furthermore, when the two-component type developer is employed using the toner according to the present invention, the carrier is not stained with the toner.

What is claimed is:

1. A toner for developing latent electrostatic images comprising:

(a) a binder resin comprising a styrene polymer or a copolymer thereof, (b) a releasing agent, dispersed in said binder resin, comprising a low-molecular-weight polypropylene with a weight-average molecular weight of 3000 to 25000, and (c) a coloring agent, dispersed in said binder resin, the content of said styrene polymer or said copolymer thereof being in a ratio of 10–50% and the content of said low-molecular-weight polypropylene being in a ratio of 5–60% at a surface portion of said toner, measured by the electron spectroscopy for chemical analysis (ESCA), and a maximum particle diameter of said low-molecular-weight polypropylene contained in said releasing agent being 5000 Å or less.

2. The toner as claimed in claim 1, wherein said styrene polymer or said copolymer thereof is prepared by polymerizing styrene or a styrene derivative selected from the group consisting of o-methylstyrene, m-methylstyrene, p-methylstyrene, p-ethylstyrene, 2,4-dimethylstyrene, p-n-butylstyrene, p-tert-butylstyrene, p-n-hexylstyrene, p-n-octylstyrene, p-n-nonylstyrene, p-n-decylstyrene, p-n-dodecylstyrene, p-methoxystyrene, p-phenylstyrene, p-chlorostyrene, and 3,4-dichlorostyrene, or by polymerizing styrene or said styrene derivative in combination with ethylene or an ethylene-based unsaturated monoolefin selected from the group consisting of propylene, butylene and isobutylene.

3. The toner as claimed in claim 1, wherein said styrene copolymer is prepared by polymerizing styrene or a styrene derivative and a halogenated vinyl compound selected from the group consisting of vinyl chloride, vinylidene chloride, vinyl bromide and vinyl fluoride.

4. The toner as claimed in claim 1, wherein said styrene copolymer is prepared by polymerizing styrene or a styrene derivative and a vinyl ester selected from the group consisting of vinyl acetate and vinyl propionate.

5. The toner as claimed in claim 1, wherein said styrene copolymer is prepared by polymerizing styrene or a styrene derivative and α-methylene aliphatic monocarboxylic acid ester selected from the group consisting of methyl acrylate, ethyl acrylate, n-butyl acrylate, methyl methacrylate and ethyl methacrylate.

6. The toner as claimed in claim 1, wherein said styrene copolymer is prepared by polymerizing styrene or a styrene derivative and vinyl methyl ether.

7. The toner as claimed in claim 1, wherein said styrene copolymer is prepared by polymerizing styrene or a styrene derivative and an N-vinyl compound selected from the group consisting of N-vinylpyrrole, N-vinylcarbazole, N-vinylindole and N-vinylpyrrolidone.

8. The toner as claimed in claim 1, prepared by kneading a mixture of said binder resin, said releasing agent and said coloring agent, and grinding said kneaded mixture by a double-screw extruder.

* * * * *